United States Patent [19]

Huggins

[11] 4,254,918

[45] Mar. 10, 1981

[54] REMOVABLE CORE FOR REELED WEB MATERIAL

[75] Inventor: Peter N. Huggins, Brentwood, England

[73] Assignee: Ciba-Geigy AG, Basel, Switzerland

[21] Appl. No.: 123,228

[22] Filed: Feb. 21, 1980

[30] Foreign Application Priority Data

Mar. 9, 1979 [GB] United Kingdom ..... 8309/79

[51] Int. Cl.[3] ..... B65H 17/02

[52] U.S. Cl. ..... 242/68.5

[58] Field of Search ..... 242/68.5, 68.3, 68.6, 242/72, 73

[56] References Cited

U.S. PATENT DOCUMENTS

| | | | |
|---|---|---|---|
| 2,571,321 | 10/1951 | Wettley | 242/72 X |
| 2,659,543 | 11/1953 | Guyer | 242/68.5 |
| 3,447,674 | 6/1969 | Fraser | 242/68.5 |

FOREIGN PATENT DOCUMENTS

| | | | |
|---|---|---|---|
| 671607 | 2/1960 | Belgium | 242/72 |
| 1571190 | 5/1969 | France | 242/68.5 |
| 350886 | 6/1931 | United Kingdom | 242/72 |
| 1434064 | 4/1976 | United Kingdom | 242/72 |

*Primary Examiner*—Edward J. McCarthy
*Attorney, Agent, or Firm*—Harry Falber

[57] ABSTRACT

Core for a roll of web material which comprises an outer tube which may be supported to assume a cylindrical form and on to which the web material is wound when in the cylindrical form and an axially displaceable insert piece which fits inside the outer tube. The outer tube being split lengthways into at least two sections which are biased towards each other by expandable binding means. The outer tube being supported in the cylindrical form by the presence of the insert piece therein.

8 Claims, 5 Drawing Figures

REMOVABLE CORE FOR REELED WEB MATERIAL

This invention relates to a core for reeled web material.

Much web material and particularly photosensitive film and paper material is transported and sold in long lengths wound to form a roll (reel). It is necessary to wind web material on to a core to form a reel and often in order to form a tightly wound reel it is required to use a relatively expensive core and usually it is required to remove such cores from the reeled web before it is sold. In practice it has proved very difficult to remove the core from a reel of tightly wound web by tapping it out of the reel. This usually results in damaging the core and the inner turns of the web reeled on the core. It is particularly difficult to remove cores from reels of wound photosensitive material because this operation must be carried out in subdued lighting or even in virtually total darkness.

Various expandable cores are known in the treatment of web material art but in general they are of complex design and not easily collapsible, for example the complex core described in Belgian patent specification no. 671607. Other cores are known which are retained in shape only by the radial compressive force of the web material wound thereon, for example French patent specification no. 1571190. Others are known which are expandable and collapsible within certain limits to enable fibres wound thereon to shrink, for example the core described in British Pat. No. 1434064, but such a core is not removable from a reeled web because it is designed to have fibre reeled up thereon and thus has flanged ends. A yet more complicated collapsible core or sheath for use in the production of textiles is described in British Pat. No. 350886 but this is really a sheath and not a core and its shape does not rely on the presence of a core therein. Further this core is of complex construction.

Thus it is the object of the present invention to provide a core for a roll of web material which is easy to remove from the roll even in the dark merely by applying an axial thrust to the core.

According to the present invention there is provided a removable core for a roll of web material which comprises an outer tube which may be supported to assume a cylindrical form and on to which the web material is wound when in the cylindrical form and an axially displaceable insert piece which fits inside the outer tube, the said outer tube being split lengthwise into at least two sections which are biased towards each other by expandable binding means, the outer tube being supported in the cylindrical form by the presence of the insert piece therein.

Preferably the axially displaceable insert piece is circular in section and most preferably it is also a tube to enable the core to be used on a conventional reeling machine. Preferably means are provided for anchoring the insert piece in the outer tube to prevent independent rotation and this is especially desirable when the insert piece is a cylindrical tube.

In operation the outer tube is expanded and supported in the cylindrical form by placing the insert piece therein. The combination of outer tube and insert piece is then placed in the reeling machine as the core of the web material and the web material is then wound thereon. After sufficient web material has been wound on to the core, the core and wound web material are removed from the reeling machine and placed on a suitable supporting means. The axially displaceable insert piece is then displaced from the outer tube which then contracts and can easily be removed from the centre of the reel of web material. Very often the reeling and removal of the core have to be carried out in the dark or at least in very low level lighting conditions for example when the web is photosensitive film or paper.

Thus the preferred material of construction of both the outer tube and the insert piece is a low coefficient of friction but relatively hard plastics material. Particularly suitable materials are polytetrafluorethylene and phenol-formaldehyde resin bonded laminate material which is sold under the trade name of Tufnol. By low coefficient of friction is meant a coefficient below 0.2. The coefficient of Tufnol is about 0.16, depending on the surface finish.

These plastics materials are sufficiently hard to act as a core for reeled material and also hard enough for the insert piece to be removed from the outer tube without being distorted. Their low coefficient of friction aids the displacement of the insert piece from the outer tube. These plastics materials are also easy to machine and cut in order to produce both the outer tube and the insert piece.

The preferred binding means is at least one rubber band which lies in a peripheral groove around the outer tube. Preferably there are at least two such rubber bands lying in a corresponding number of grooves.

Means may be attached to the displaceable insert piece for aiding its displacement from the outer tube. However in practice it is only necessary to push or lightly tap the insert piece to displace it from the outer tube.

In one embodiment the axially displaceable insert piece can be removed entirely from the outer tube. In another embodiment the displaceable insert piece is axially displaceable from the outer tube to allow the outer tube to contract but is still connected to the outer tube.

Preferably when the insert piece is a tube the outer tube and the tubular insert pieces are the same length and when the tubular insert piece is inserted and anchored in the outer tube each end of the core presents a planar surface which can be used in the reeling operation.

When it is not required that each end of the core presents a planar surface the end of the insert piece may be shaped or chamfered to aid insertion in the outer tube.

The accompanying drawings will serve to illustrate the invention.

Figure 1:
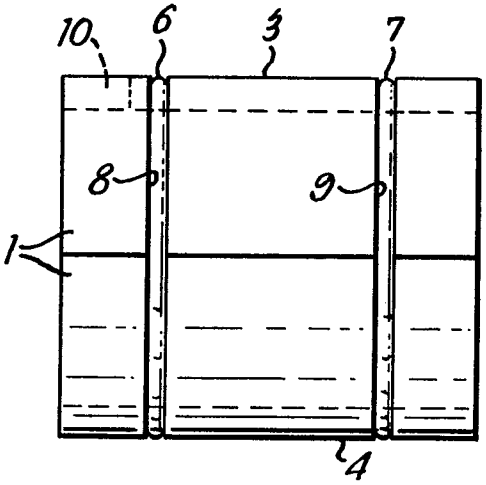
FIG. 1 is a lengthwise view of an outer tube.

In FIG. 1 an outer tube 1 is formed from two lengthwise part-cylindrical sections 3 and 4. Sections 3 and 4 are held together by rubber bands 6 and 7 in grooves 8 and 9. An anchor slot 10 is present at one circumferential end of the outer tube 1. The tube 1 is in the contracted condition.

Figure 2:
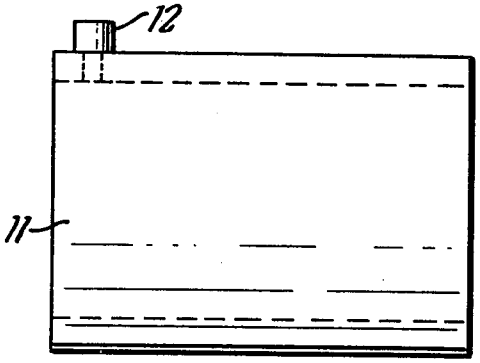
FIG. 2 is a lengthwise view of an insert piece.

In FIG. 2 a cylindrical tube 11 comprises the insert piece. Tube 11 carries an anchoring stud 12 on its peripheral surface.

Figure 3:
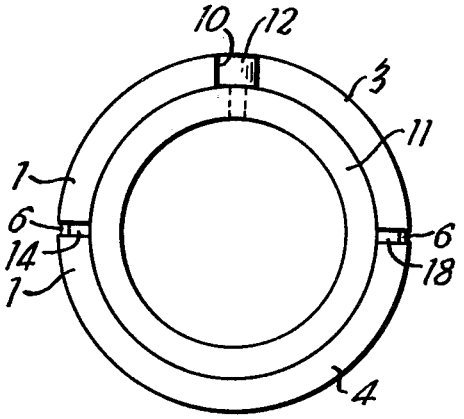
FIG. 3 is an end view of the insert piece of FIG. 2 in the outer tube of FIG. 1.

In FIG. 3 the tube 11 is shown inserted in the outer tube 1. The two halves 3 and 4 of tube 1 are shown separated by gaps 14 and 18 but held together by the bands 6 and 7 (only band 6 is shown in this view). The stud 12 is shown accommodated in the anchor slot 10. The tube 1 has been expanded by the insertion of tube 11 to become completely cylindrical and is supported in the cylindrical form by the presence therein of the inner tube 11.

The core of FIG. 3 is a combination of the outer tube 1 and the inner tube 11. The core of FIG. 3 can now be fitted on the spindle of a reeling machine and a length of web material can now be reeled thereon by cinch winding to secure the free end of the core. When the requisite size reel has been wound on the core, the web material can be cut and the leading end secured on to the wound material. The core plus reeled web material can then be removed from the spindle of the reeling machine and held in a suitable position so that an end portion of the tube 11 remote from the stud 12 can be pushed or tapped smartly with a suitable shaped striking instrument. This causes tube 11 to be forced out of tube 1. As soon as all tube 11 is outside tube 1, tube 1 then contracts so that there is no gap between lengthwise sections 3 and 4. This contraction of the diameter of the outer tube in one direction enables the outer tube to be removed from the reeled film by pushing axially or tapping one end smartly and holding tightly the reeled film. Thus both the inner tube 11 and the outer tube 1 are easily removed leaving the tightly wound reel of web material. Both these operations can be carried out in the dark or under very low light conditions.

Figure 4:
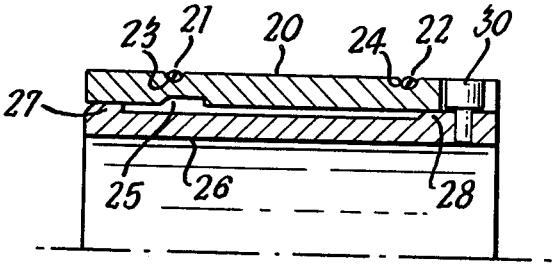
FIGS. 4 and 5 show a sectional view of an alternative embodiment in which the insert piece is still connected to the outer tube after axial displacement.
Figure 5:
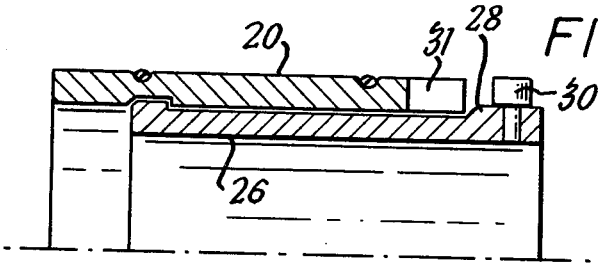

FIGS. 4 and 5 illustrate an alternative embodiment in which an inner tube is displaceable in respect of the outer tube but is not withdrawn therefrom.

In FIGS. 4 and 5 the outer tube 20 is in two lengthwise sections but this is not shown in either figure.

Outer tube 20 has expandable rubber rings 21 and 22 in grooves 23 and 24 holding together the two lengthwise sections. On the inner surface of the outer tube is an annular recess 25.

The inner tube 26 has at one end an annular abutment member 27 having the outer edge chamfered as shown. At the other end tube 26 has another annular abutment member 28 having an inner edge chamfered as shown. Abutment member 27 is adapted to fit into the annular recess 25.

A stud 30 attached to inner tube 26 fits into a slot 31 on the outer tube 20.

When the inner tube 26 is present in the outer tube 20 as shown in FIG. 4 the outer tube is in the expanded form. A web of material is wound on to the core shown in FIG. 4. To cause the outer tube to contract the end of the inner tube which has abutment member 27 is pushed axially. This causes the abutment member 27 to be accommodated in the recess 25 and member 28 to protrude out of the tube as shown in FIG. 5. This allows the outer tube 20 to contract so that it can be removed from a reel of wound film by being pushed axially.

I claim:

1. A removable core for a roll of web material which comprises an outer tube which may be supported to assume a cylindrical form and on to which the web material is wound when in the cylindrical form and an axially displaceable insert piece which fits inside the outer tube, the said outer tube being split lengthways into at least two sections which are biased towards each other by expandable binding means, the outer tube being supported in the cylindrical form by the presence of the insert piece therein.

2. A removable core according to claim 1 wherein the axially displaceable insert piece is circular in section.

3. A removable core according to claim 2 wherein the axially displaceable insert piece is a cylindrical tube.

4. A removable core according to claims 1, 2 or 3 wherein means are provided for anchoring the insert piece in the outer tube.

5. A removeable core according to claim 1 wherein the expandable binding means is at least one rubber band which lies in a peripheral groove around the outer tube.

6. A removable core according to claim 1 wherein the axially displaceable insert piece can be removed entirely from the outer tube.

7. A removable core according to claim 3 wherein the piece and the outer tube are the same length and when the inner is present in the outer tube each end of the core presents a planar surface.

8. A removable core according to claim 1 wherein both the outer tube and the axially displaceable insert piece are composed of a phenol-formaldehyde resin bonded laminate material.

* * * * *